US010774482B2

(12) United States Patent
Mahlberg et al.

(10) Patent No.: US 10,774,482 B2
(45) Date of Patent: Sep. 15, 2020

(54) WORKING DEVICE

(71) Applicant: Wirtgen GmbH, Windhagen (DE)

(72) Inventors: Axel Mahlberg, Ruppichteroth (DE); Klaus Vollmann, Waldbröl (DE); Sebastian Bötzius, Siegburg (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 389 days.

(21) Appl. No.: 14/954,709

(22) Filed: Nov. 30, 2015

(65) Prior Publication Data

US 2016/0177520 A1 Jun. 23, 2016

(30) Foreign Application Priority Data

Dec. 17, 2014 (DE) ..... 10 2014 118 802

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC .... E01C 23/088; E01C 23/09; E01C 23/2312; E01C 23/12
USPC ..... 404/117, 130, 75, 76, 90–94; 74/61, 87; 299/36.1, 39.1, 39.2, 39.4–39.6
See application file for complete search history.

(56) References Cited

U.S. PATENT DOCUMENTS 508,157 A * 11/1893 Wilson
1,104,502 A * 7/1914 Hist ..... E01C 19/26 172/350
1,538,550 A * 5/1925 Hamilton ..... A01B 29/02 172/350
2,559,427 A * 7/1951 Hastings ..... E01C 19/266 404/128
3,008,389 A * 11/1961 Hicks ..... E02D 3/026 404/121
3,078,730 A * 2/1963 Clements ..... B06B 1/165 209/367
3,238,799 A * 3/1966 Baker ..... B07B 1/42 198/770
4,006,936 A 2/1977 Crabiel
5,846,176 A * 12/1998 Zieger ..... B05C 17/02 492/13

(Continued)

FOREIGN PATENT DOCUMENTS

DE 19547698 A1 6/1997
DE 20122928 U1 4/2010
GB 11 560 * 9/1904

*Primary Examiner* — Sunil Singh
(74) *Attorney, Agent, or Firm* — Lucian Wayne Beavers; Patterson Intellectual Property Law, PC

(57) ABSTRACT

The invention relates to a working device for a ground-processing device having a milling drum with a milling drum tube on whose surface working tools are mounted in a projecting manner and are intended to come into contact with the material to be milled during the milling process, wherein the working device has a powertrain for driving the milling drum. In order to improve the running smoothness of a ground-processing machine, provision is made according to the invention for at least one load weight to be arranged, preferably interchangeably, on the powertrain and/or on the milling drum to increase the kinetic energy.

19 Claims, 3 Drawing Sheets

(56) References Cited

U.S. PATENT DOCUMENTS

| | | | | |
|---|---|---|---|---|
| 7,644,994 | B2 | 1/2010 | Busley et al. | |
| 2002/0192025 | A1 * | 12/2002 | Johnson | E01C 23/088 404/75 |

* cited by examiner

WORKING DEVICE

BACKGROUND OF THE INVENTION

1. Field of the Invention

The invention relates to a working device for a ground-processing device having a milling drum with a milling drum tube on whose surface working tools are mounted in a projecting manner and are intended to come into contact with the material to be milled during the milling process, wherein the working device comprises a powertrain for driving the milling drum.

2. Description of the Prior Art

Ground-processing machines are known in a wide variety of embodiments. For example, DE 201 22 928 U1 (U.S. Pat. No. 7,644,994) discloses a road milling machine as a ground-processing machine. It has a powertrain. This comprises a drive engine, a shifting clutch and a gearbox (what is referred to as the "milling drum gearbox"), and also elements, in particular shafts, toothed or endless drives, which interconnect these units. Within the scope of the invention, a powertrain is to be understood in particular under the above definition. According to DE 201 22 928 U1, use is made of a milling drum which is fitted with working tools on the surface of its milling drum tube. Working tools are to be understood as meaning the constructional units of the milling drum which functionally interact with the material to be milled during the working process. For example, these are milling chisels and the holder systems supporting the milling chisels. Furthermore, working tools frequently mounted on the milling drum are guiding and ejecting tools. These have guiding and conveying functions.

When using a machine according to the invention, the work result is decisively influenced by the rotational speed of the milling drum. In this context, the optimal rotational speed is generally dependent on the application.

During fine milling of road surfaces, to restore the skid resistance, with a small milling depth, relatively high rotational speeds are required in order to produce a uniform milling pattern. Therefore, only a surface processing takes place here.

When removing all or a number of layers of the road structure, lower rotational speeds tend to be more favorable since it has been shown that, as a result, a better milling pattern with a smaller generation of fine particle fragments, and therefore reduced dust generation, can be ensured. Moreover, the wear on the milling tools is considerably reduced at low rotational speeds. Furthermore, with a reduced rotational speed of the milling drum, a reduced output power of the drive is also required and thus a lower fuel consumption is made possible. Overall, it should therefore be sought to achieve a rotational speed of the milling drum which is as low as possible in such applications.

In order to meet the various requirements, it is therefore known to be able to variably set the rotational speed of the milling drum in road milling machines.

However, if the rotational speed is selected to be too low, the kinetic energy of the milling drum is no longer sufficient to effectively process the material to be milled, there occurring an out-of-round and unsmooth running of the milling drum which is demonstrated, inter alia, by vibrations of the entire ground-processing machine right through to unstable oscillation of the machine, here possibly also resulting in damage to the machine. Furthermore, the work quality suffers as a result of the unsmooth running of the milling drum, and unevenness in the milling pattern can occur. In the extreme case, it is possible for the milling drum to "bog down" if the kinetic energy is not sufficient.

A high weight of the ground-processing machine contributes to increasing the running smoothness even at low rotational speeds. However, this is disadvantageous in many respects since as a result, on the one hand, particular requirements must be placed on transportation (large milling machines>40t→heavy transport) and, on the other hand, the use possibilities are restricted to grounds which have statically little load-bearing capacity.

It is therefore known to load milling machines for stabilization purposes. For this purpose, additional weights are fastened on the machine. Thus, it is known for example that, in a road milling machine having a total weight of about 4.5 tonnes, 1.3 tonnes can be made available by means of additional weights. In other words, the additional weights make up barely ⅓ of the machine weight. Such a machine can thus be used flexibly but must be loaded with large additional weights for optimal adaptation to the respective task.

U.S. Pat. No. 4,006,936 A discloses a ground-processing machine having a milling device. To improve the running smoothness of the milling drum, the use of a milling drum tube which has a greater wall thickness than customary milling drum tubes is recommended. This course of action proves to be disadvantageous particularly during manufacture since the milling drum tubes are rolled from a sheet-like blank. The rolled blank is then welded at its longitudinal-side abutment points. The tube thus manufactured and welded must then be turned. The large material thickness increases the manufacturing expenditure. The use of the relatively thick blank causes a considerable increase in the forming work expenditure. Owing to the large wall thickness, the milling drum tube can be manufactured only with a significant degree of out-of-roundness, with the result that increased machining effort is required during turning.

Moreover, in this design of the milling drum tube, flexible adaptation to the respective task cannot occur.

SUMMARY OF THE INVENTION

It is thus the object of the invention to provide a working device of the type mentioned at the outset which allows optimization of the rotational speed of the milling drum, wherein an optimum cutting pattern can be produced in a simple manner in different applications.

This object is achieved in that at least one load weight is arranged, preferably interchangeably, on the powertrain and/or on the milling drum to increase the kinetic energy.

The invention is based on the finding that a relatively high running smoothness of the milling drums can be achieved when the kinetic energy in the powertrain and/or the milling drum is increased. The kinetic energy is obtained from the formula $$E_{rot}=\tfrac{1}{2}m\,r^2\omega^2$$

where m is the value of the rotating mass and r the distance of this mass from the axis of rotation. The product $mr^2$ represents the moment of inertia of the moving mass and ω represents the angular velocity (2*π*rotational speed). Since the reduction of the rotational speed is desired, the invention is then concerned with changing the moment of inertia. In this context, one or more load weights are installed on one or more rotating parts of the powertrain or the milling drum.

Tests have revealed that, under otherwise identical conditions, the power consumption during the milling process can be lowered by up to 30% by reducing the rotational speed with a simultaneous increase in the moment of inertia. Consequently, in addition to the fuel requirement, the chisel wear and the coolant requirement are also reduced. In this way, the mass of the entrained coolant (water) can be decreased in favor of a lower machine weight.

Moreover, a reduction in the rotational speed also affords the advantage of a longer running time of the machine before it has to be filled with coolant. Furthermore, owing to the lower rotational speed, the dust generation is reduced, which leads to a further reduction in the water requirement.

Furthermore, it has been shown that, with an increase in the moment of inertia caused by the weight-loading on the milling drum and/in the powertrain, the same increase in the running smoothness can be achieved as by a considerably higher weight-loading of the entire machine. Here, under otherwise identical circumstances, integral factors can lie in between.

Therefore, as a result of the increase in the moment of inertia, there is also the possibility of reducing the entire weight of the machine with the running smoothness remaining the same. Therefore, it is possible to use the machine more flexibly and transportation is simplified.

Overall, matching between the rotational speed of the drum and machine weight that is suitable to the application is thus made possible in that a corresponding weight-loading of the milling drum and/or of the powertrain is selected for the respective application.

This is particularly advantageous in the case of interchangeable weights since hereby a machine and/or milling drum can be used for different tasks and optimally adapted for these in each case in a simple manner.

The load weight can be arranged at any desired point of the powertrain or on the milling drum. Accordingly, it can be positioned, for example, downstream of the drive engine.

According to a preferred variant embodiment of the invention, it can be provided that the powertrain has a clutch and a gearbox connected downstream thereof via a belt drive, for example, and that the load weight is arranged downstream of the gearbox or therein on the output side.

This arrangement leads to the clutch and gearbox being relieved since the shock factor acting on them is then reduced. If the load weight or weights is/are arranged downstream of the gearbox, this constructional unit can also be effectively relieved. As a result, the service life of the clutch and gearbox is increased.

The load weight can be connected fixedly to the powertrain or the milling drum. However, it is preferably interchangeable. In this way, it can then be built onto the ground-processing machine if it is specifically required for the purpose of the desired running smoothness. Thus, weight-optimized adaptation of the machine can also be carried out here. Moreover, the machine transportation is also simplified since the load weight or weights can be separately handled, for example transported. Furthermore, the change of drums is simplified since a lighter drum can be changed and handled more simply.

In a particularly preferred manner, it is provided that at least one load weight is arranged in the region of the milling drum. Here, the load weight can be used particularly effectively since it can be arranged at a large distance from the axis of rotation. This leads to a particular increase in the running smoothness since the moment of inertia, and hence the kinetic energy, are a square function of the distance of the mass from the axis of rotation. Thus, the same effect can be achieved with relatively small load weights at a large distance from the axis of rotation as with large load weights at a small distance from the axis of rotation. The arrangement in the region of the milling drum also affords handling advantages. In particular, the load weights are readily accessible here if they are arranged interchangeably.

A significant increase in the running smoothness is obtained when it is provided that the load weight or weights has/have a mass which is suitable for increasing the moment of inertia of the milling drum by at least 10%, particularly preferably by at least 20%. Moreover, with an increase by at least 20%, there is obtained the advantage that a considerable lightening in the machine weight is also possible. An experimental design of the inventor revealed that a weight-loading of the milling drum by 100 kg allows a reduction in the overall machine weight by 100 kg with the running smoothness remaining the same.

One conceivable variant of the invention is such that the powertrain and/or the milling drum are/is adapted in such a way that the load weights make it possible to increase the weight in two or more stages. In this way, the ground-processing machine can be adapted step by step to the desired work task. Moreover, particularly simple handling is associated with this subdivision of the load weights.

A ground-processing machine according to the invention can be such that the powertrain and/or the milling drum have arranged thereon receptacles with fastening means by means of which the load weight or weights can be coupled interchangeably. In this way, the load weights can be positioned and fastened securely and reliably in harsh construction site operation. Here, the load weights can be formed, for example, by segments or rings or similar constructional units. The ground-processing machine may also provide for the storage of the load weights on the chassis and/or on the running-gear units of the machine, on supports provided for this purpose, when the load weights are not in use.

It is particularly advantageous if provision is made for the load weight or weights to be mounted in the interior enclosed by the milling drum tube, preferably on the inner side of the milling drum tube. The load weights are then protected from attack by the material to be milled in a simple manner.

One possible configuration of the invention can be such that the load weight is formed by a fluid which is held in a fluid reservoir. For example, the fluid used can be water. This can be simply let out again after use.

According to the invention, it can also be provided that the milling drum can be releasably mounted on coupling pieces of the powertrain by means of a fastening arrangement, and that the load weights are arranged interchangeably on the fastening arrangement. Here, the load weights are readily accessible particularly when the milling drum has been demounted.

Alternatively, to ensure simple accessibility, it is possible for the load weights to be arranged in the axially outer region of the milling drum. This affords the possibility of (de) mounting the additional weights without the milling drum having to be removed from the powertrain for this purpose.

Furthermore, it is possible to combine the various fastening possibilities so that a "small" weight-loading can occur without large effort (for example without demounting the milling drum). Moreover, should it be sought to achieve a greater weight-loading, additional weights can be fastened inside the milling drum after it has been demounted.

Overall, it is recommended for the benefit of a high running smoothness for the rotating component, for example the milling drum, equipped with the load weight or weights to be designed in such a way that it is balanced. In order to avoid unbalances, it is recommended in this respect for example also to arrange the load weights in a symmetrically distributed manner.

One conceivable configuration of the invention is such that a cured casting material, preferably concrete, is used as the load weight. This measure makes it possible to effectively provide the weight-loading in a cost-effective and simple manner.

The weight-loading according to the invention is possible not just in mechanical drives with an internal combustion engine. Rather, weight-loading is also possible in other drive variants of the milling drum. For example, it is conceivable for hydraulic or electrical milling drum drives to be weight-loaded on their rotating components and/or the milling drum, where the same advantages can be achieved.

BRIEF DESCRIPTION OF THE DRAWINGS

The invention will be explained in more detail below with reference to exemplary embodiments illustrated in the drawings, in which.

DETAILED DESCRIPTION

Figure 1:
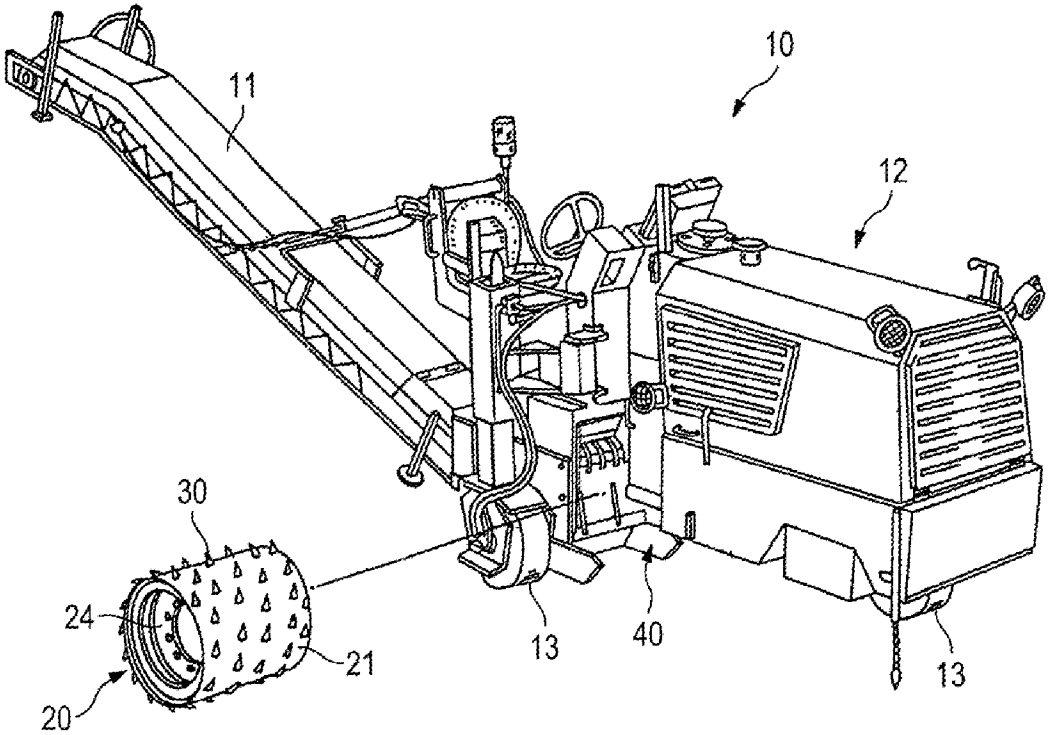
FIG. 1 shows a ground-processing machine in a perspective view.
Figure 2:
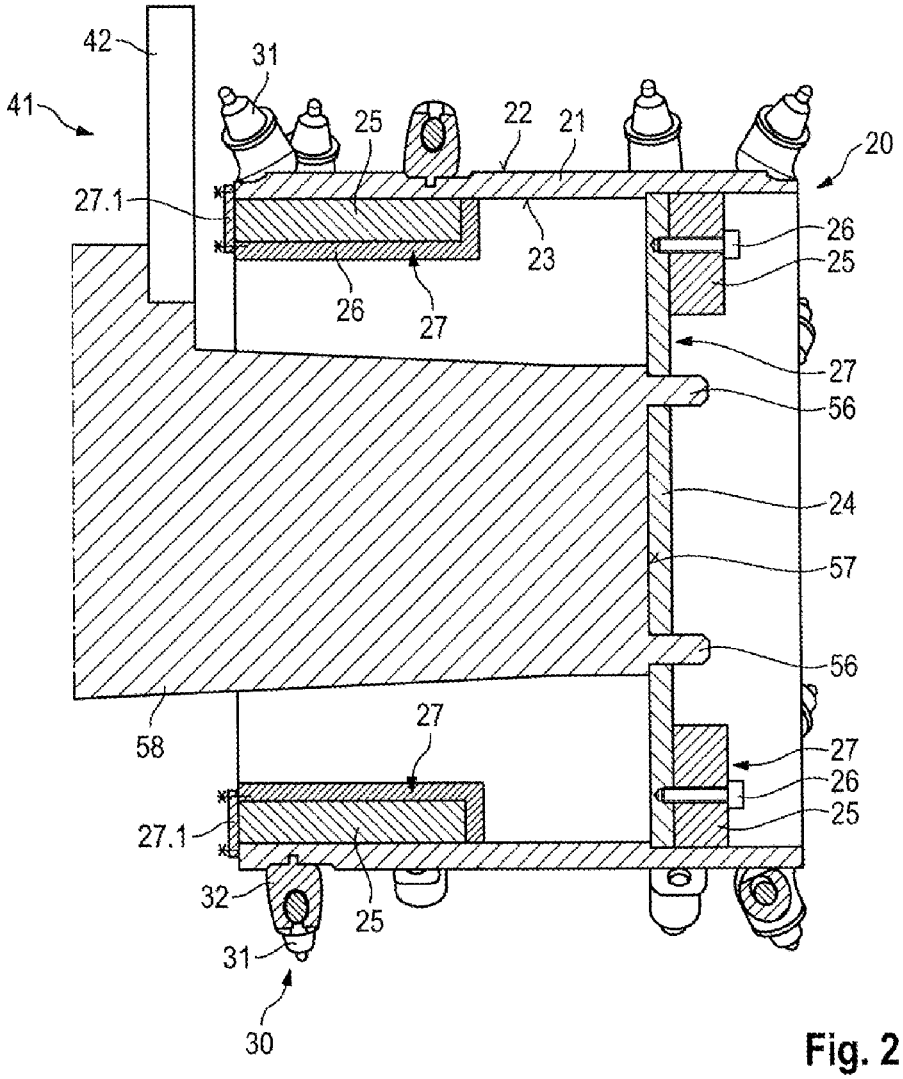
FIG. 2 shows, in a side view and in section, part of a working device having a milling drum.

FIG. 1 shows a self-propelled ground-processing machine 10, namely a road milling machine. The ground-processing machine 10 has a chassis 12 which is assigned a driver's cab. A milling drum 20 is mounted in a milling drum box 41. The milling drum 20 has a milling drum tube 21 on whose surface 22 work tools 30 are mounted in a projecting manner. The work tools 30 are illustrated only schematically in FIG. 1. The work tools 30 usually comprise a chisel holder 32 in which a chisel 31 is arranged interchangeably. The chisel holder 32 can be formed in one piece and, as illustrated in FIG. 2, fastened, for example welded, directly to the milling drum tube 21. Moreover, however, other embodiments are also known for chisel holders 32; for example, they can be formed by an upper part and a base part, with the upper part being held interchangeably in the base part, which is fastened to the milling drum tube 21. One or more chisels 31 can be fastened interchangeably in the chisel holder 32 itself.

As has been mentioned above, the milling drum 20 can be installed in the milling drum box 41 of the chassis 12. For this purpose, the milling drum 20 has a fastening arrangement 24. This can be designed, for example, in the form of a fastening flange. The milling drum 20 can be connected interchangeably to the ground-processing machine 10 by the fastening arrangement 24.

Finally, as can further be seen from FIG. 1, the chassis 10 has running-gear units 13 and a conveying device 11 is provided. For example, the running-gear units 13 can have wheels or crawler track units. In the exemplary embodiment shown, the rear right-hand running-gear unit is arranged pivotably so as, in the folded-in state, to allow milling close to an edge. Here, with the right-hand running-gear unit in the folded-out state, the milling drum 20 is arranged between the running-gear units 13 of the rear axle. At least the rear running-gear units are preferably height-adjustable in order to allow adjustment of the milling depth.

In the exemplary embodiment illustrated, the milling drum 20 and the running-gear units 13 are driven via a drive engine 51.

In the case of large milling machines, stabilizers, recyclers and surface miners, it is possible within the scope of the invention for the milling drum 20 to be arranged, for example, between the running-gear unit axes of the front and rear axle.

The conveying device 11 can be used to transport away the milled material removed by the milling drum 20. The conveying device usually has one or more conveyor belts, of which at least the final conveyor belt as seen in the conveying direction can be pivoted relative to the machine frame about a horizontal and a vertical axis.

FIG. 2 now shows by way of example the design of the milling drum 20 in section. As can be seen from this illustration, the milling drum 20 has a milling drum tube 21. This is formed substantially as a hollow cylinder and has an outwardly directed surface 22 and an inner side 23. The fastening arrangement 24 is mounted in the inner region enclosed by the milling drum 20, namely being welded to the inner side 23 of the milling drum tube 21. The fastening arrangement 24 is designed as a fastening flange and has plug receptacles. Coupling pieces 56 of a drive section 58 are inserted through the plug receptacles. The coupling pieces 56 are plug-shaped and have an external thread. A nut can be screwed onto the external thread and the fastening arrangement 24 can thus be connected to the drive section 58. Here, in the mounted state, the fastening arrangement 24 butts against an end stop 57 of the drive section 58. Secure support in the axial direction is thus provided here.

The drive section 58 is part of a powertrain 50. The powertrain 50 can, for example, have a drive engine 51 to which a gearbox 53 is connected via a clutch 52 and a belt drive. As can be seen from FIG. 2, the drive section 58 is guided through an opening in a bearing wall 42 of the milling drum box 41.

Load weights 25 can be fastened to the milling drum 20. Here, the load weights 25 are connected, preferably interchangeably, to the milling drum 20. The interchangeable mounting can also be described as being removably mounted or as a detachable connection. For example, provision can be made in this respect for fastening means 26 to be arranged in a protected manner in the inner region of the milling drum tube 21. The fastening means 26 are particularly preferably arranged on the inner side 23 of the milling drum tube 21 and/or on the fastening arrangement 24.

FIG. 2 illustrates two examples of the arrangement of load weights 25. For example, the fastening means 26 can be formed as screw bolts on the fastening arrangement 24. The load weights 25 can be pushed with fitting fastening receptacles onto said screw bolts. The load weights 25 can then be secured by means of nuts. It is further conceivable that the fastening means 26 comprise receptacles 27 into or onto which load weights 25 are pushed. In FIG. 2, by way of example, a receptacle 27 in the form of a pocket is fastened to the inner side 23 of the milling drum tube 21. The load weight 25 can be pushed into this pocket. Said load weight can then be secured by means of a cover 27.1. The cover 27.1 can be screwed for example to the fastening means 26 and/or the milling drum tube 21. It is also conceivable for the receptacle 27 provided to be a region in the milling drum tube 21 into which segments or rings are inserted.

The load weights 25 serve to increase the moment of inertia of the milling drum in favor of improved running smoothness. This has been comprehensively described at the outset. Reference is made to the corresponding statements.

The load weights 25 are preferably radially outwardly spaced apart as far as possible and therefore, as shown in FIG. 2, advantageously situated in the region of the inner side 23 of the milling drum tube 21. In this way, the moment of inertia of the milling drum is significantly influenced. Instead of the embodiment, shown in FIG. 2, of the load weights 25 as insert parts, for example in the form of iron parts or weights which can be screwed on, provision can also be made for a cavity to be formed on the milling drum 20, which cavity is filled with a casting material, for example with concrete, or into which cavity a fluid can be filled and let out again.

It is also conceivable for the load weights 25 to be fastened, preferably interchangeably, to the drive section 58 since they are readily accessible here when the milling drum 20 has been removed.

Figure 3:
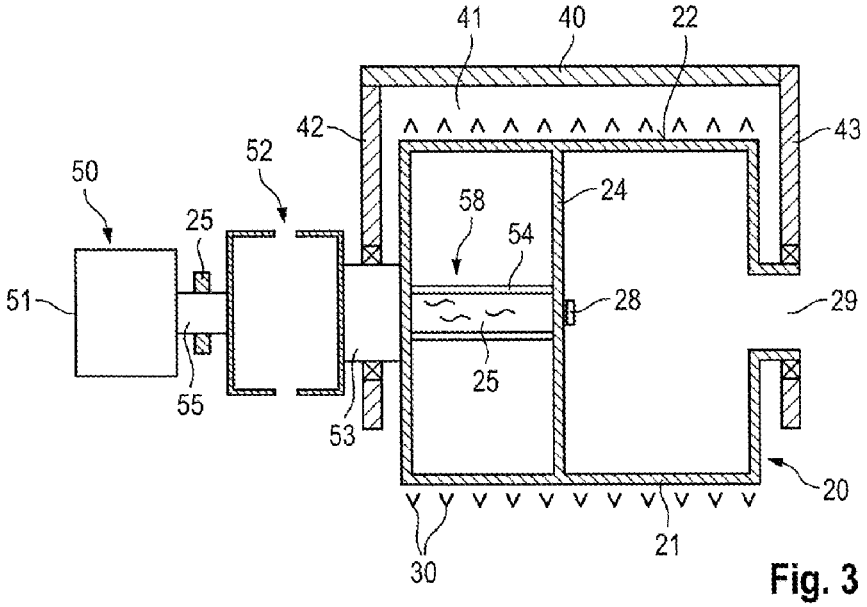
FIG. 3 shows a schematic illustration of a milling unit having a powertrain and a milling drum in a sectional view.

FIG. 3 shows a further variant embodiment of the invention. This illustration shows the housing 40 of the chassis 12 by way of example. The housing 40 forms the milling drum box 41. This is partitioned off by means of a bearing wall 42. On the opposite side to the bearing wall 42, the milling drum box 41 is closed off by an end wall 43. A clutch 52 and a gearbox 53 of a powertrain 50 are accommodated outside the milling drum box 41. However, it is also possible, for example, for the gearbox 53 to be arranged at least partially in the milling drum 20. A drive engine 51 is coupled to the clutch 52 via a drive shaft 55. The drive engine 51 is usually a diesel engine which is accommodated in the chassis 12 of the ground-processing machine 10. The clutch 52 is suited to being coupled to the gearbox 53, for example by means of a further drive shaft or by means of an endless drive. The gearbox 53 itself is connected on the output side to the milling drum 20. Here, the connection can be carried out so as to correspond to the fastening shown in FIG. 2. As can be seen from FIG. 3, the powertrain 50 comprises the drive engine 51, the clutch 52 and the gearbox 53. Furthermore, the powertrain 50 includes the drive shaft 55 and the remaining drive shafts or endless drives interconnecting the aforementioned components.

The milling drum 20 again has on its external surface 22 the work tools 30 mounted in a projecting manner. Emanating from the gearbox 53, a drive section 58 is again introduced into the interior of the milling drum 20 and connected to a fastening arrangement 24 of the milling drum 20. It can now be seen from FIG. 3 that the rotatable drive section 58 has a hollow chamber as fluid reservoir 54. A liquid, for example water, can be filled into the hollow chamber via a filler connector 28. The liquid then serves as a load weight 25. The filler connector 28 is designed in such a way that, after use of the milling drum 20, the water can be let out again from the fluid reservoir 54.

In addition, or as an alternative, according to the invention load weights can be mounted at any desired point of the powertrain on the rotating parts. FIG. 3 shows by way of example the mounting of a load weight 25 in the region of the drive shaft 55. However, the load weight is advantageously mounted in the region downstream of the gearbox 53 on a rotating part of the powertrain 50. The shock loading of the gearbox 53 and the clutch 52 is thus minimized. In addition, the damping of interposed drive components, for example belt drives, is then minimized.

There are essentially the following possibilities for mounting the load weights 25 which come advantageously into consideration:

milling drum 20 output side of the gearbox 53 (for example drive section 58)

input side of the gearbox 53 (for example belt disk upstream of gearbox 53)

output side of the clutch 52 (for example belt disk downstream of clutch 52, upstream of belt drive to the gearbox 53)

input side of the clutch 52 or alternatively in the clutch 52 or in the gearbox 53.

As the above examples show, the load weights 25 can be fixedly or interchangeably connected to the powertrain 50 or the milling drum 20. Interchangeable fastening offers the advantage that the machine can be flexibly adapted to different boundary conditions and tasks.

As the above statements show, the invention relates to a new working device for a ground-processing machine 10 having a milling drum 20. The milling drum 20 is assigned a powertrain 50 for driving the milling drum 20. To increase the moment of inertia, load weights 25 are now provided in the region of the powertrain 50 and/or the milling drum 20.

The invention claimed is:

1. A ground-processing machine, comprising:

a milling drum including a milling drum tube and a plurality of working tools projecting from the milling drum tube for contacting material to be milled, the milling drum having an axis of rotation;

a powertrain operatively connected to the milling drum to drive the milling drum, the powertrain including a clutch and a gearbox downstream of the clutch; and at least one non-liquid load weight interchangeably and symmetrically mounted on the gearbox within an interior of the milling drum to increase a kinetic energy of the milling drum while maintaining balance of the milling drum, the at least one non-liquid load weight being symmetrically mounted about the axis of rotation of the milling drum.

2. A ground-processing machine, comprising:

a milling drum including a milling drum tube and a plurality of working tools projecting from the milling drum tube for contacting material to be milled, the milling drum having an axis of rotation;

a powertrain operatively connected to the milling drum to drive the milling drum; and at least one load weight interchangeably and symmetrically mounted on the milling drum to increase a kinetic energy of the milling drum while maintaining balance of the milling drum, the at least one load weight being symmetrically mounted about the axis of rotation of the milling drum;

wherein the milling drum includes at least one fastener configured to interchangeably fasten the at least one load weight.

3. The machine of claim 2, wherein:

the at least one load weight has a mass and location configured to increase a moment of inertia of the milling drum by at least 10%.

4. The machine of claim 2, wherein:

the at least one load weight has a mass and location configured to increase a moment of inertia of the milling drum by at least 20%.

5. The machine of claim 2, wherein:

the at least one load weight has a mass of at least 100 kg.

6. The machine of claim 2, wherein:

the at least one load weight has a mass of at least 200 kg.

7. The machine of claim 2, wherein:

the at least one load weight is interchangeably mounted on the milling drum in two or more stages.

8. The machine of claim 2, wherein:

the milling drum includes at least one receptacle for interchangeably receiving the at least one load weight.

9. The machine of claim 2, wherein:

the at least one load weight is interchangeably mounted inside of the milling drum tube.

10. The machine of claim 9, wherein:

the at least one load weight is located adjacent an inner side of the milling drum tube.

11. The machine of claim 2, wherein:

the at least one load weight is made of concrete.

12. The machine of claim 2, wherein the machine is a road milling machine.

13. A milling drum, comprising:

a milling drum tube having an axis of rotation;

a plurality of working tools mounted on the milling drum tube and projecting outward from the milling drum tube for contacting a material to be milled;

at least one load weight removably and symmetrically mounted on the milling drum to increase kinetic energy of the milling drum while maintaining balance of the milling drum, the at least one load weight being symmetrically mounted about the axis of rotation of the milling drum tube; and at least one receptacle attached to the milling drum tube for receiving the at least one load weight.

14. The milling drum of claim 13, wherein:

the at least one load weight has a mass and location configured to increase a moment of inertia of the milling drum by at least 10%.

15. The milling drum of claim 13, wherein:

the at least one load weight has a mass and location configured to increase a moment of inertia of the milling drum by at least 20%.

16. The milling drum of claim 13, wherein:

the at least one load weight has a mass of at least 100 kg.

17. The milling drum of claim 13, wherein:

the at least one load weight has a mass of at least 200 kg.

18. The milling drum of claim 13, wherein:

the at least one load weight is mounted inside of the milling drum tube.

19. A milling drum, comprising:

a milling drum tube having an axis of rotation;

a plurality of working tools mounted on the milling drum tube and projecting outward from the milling drum tube for contacting a material to be milled;

at least one load weight removably and symmetrically mounted on the milling drum to increase kinetic energy of the milling drum while maintaining balance of the milling drum, the at least one load weight being symmetrically mounted about the axis of rotation of the milling drum tube; and at least one reservoir attached to the milling drum tube and filled with liquid, the liquid being the at least one load weight.

* * * * *